US007473053B1

(12) United States Patent
Brochu et al.

(10) Patent No.: US 7,473,053 B1
(45) Date of Patent: Jan. 6, 2009

(54) ARCH SHAPE CROSS SECTION CHAMBER HAVING CORRUGATIONS WITH FLATTENED WEB SEGMENTS

(75) Inventors: Ronald P. Brochu, Westbrook, CT (US); James J. Burnes, Deep River, CT (US)

(73) Assignee: Infiltrator Systems, Inc., Old Saybrook, CT (US)

( * ) Notice: Subject to any disclaimer, the term of this patent is extended or adjusted under 35 U.S.C. 154(b) by 85 days.

(21) Appl. No.: 10/977,783

(22) Filed: Oct. 29, 2004

(51) Int. Cl.
*E02D 13/00* (2006.01)
*E02D 11/00* (2006.01)

(52) U.S. Cl. ..... 405/49; 405/46

(58) Field of Classification Search ..... 405/43, 405/44, 45, 46, 47, 48, 49; 210/170; 52/88, 52/81.6, 79.4
See application file for complete search history.

(56) References Cited

U.S. PATENT DOCUMENTS 980,442 A * 1/1911 Schlafly ..... 405/48
4,099,359 A * 7/1978 Sivachenko ..... 428/163
4,360,042 A * 11/1982 Fouss et al. ..... 405/45
4,523,613 A * 6/1985 Fouss et al. ..... 405/43
5,087,151 A * 2/1992 DiTullio ..... 405/43
5,511,903 A 4/1996 Nichols et al. ..... 405/43
5,588,778 A * 12/1996 Nichols et al. ..... 405/48
6,679,653 B1 * 1/2004 DiTullio ..... 405/49
2002/0044833 A1 * 4/2002 Kruger et al. ..... 405/43

* cited by examiner

*Primary Examiner*—M. Safavi
(74) *Attorney, Agent, or Firm*—C Nessler

(57) ABSTRACT

An injection molded plastic corrugated leaching or storm water chamber has a peak corrugations segment with a flattened and thickened web. The web is the portion of the corrugation which runs from the peak to the floor of the adjacent valley. Preferably, flattened web segments are at the apexes of adjoining corrugations, to create an increased thickness band region, running lengthwise along the chamber from an injection nozzle location or sprue. The flattened web segments enable better melted plastic flow during molding, without increasing nesting height.

18 Claims, 6 Drawing Sheets

ARCH SHAPE CROSS SECTION CHAMBER HAVING CORRUGATIONS WITH FLATTENED WEB SEGMENTS

TECHNICAL FIELD

The present invention relates to corrugated, arch shape cross section thermoplastic chambers made by injection molding.

BACKGROUND

Arch shape cross section corrugated chambers that are made of thermoplastic have been widely used for leaching of water into the earth in recent years. For example, they have been used in connection with septic systems and for receiving and dispersing storm waters. Some of such chambers are made by thermoforming of sheet. The better chambers are made by injection molding of thermoplastic, and, they have had internal and external ribs. The ribs provided strength, to resist the forces from soil, or from vehicles on the soil surface, during use.

The strengthening ribs of chambers serve the additional purpose of providing thicker sections in the injection mold cavity, through which melted plastic from sprues, i.e., injection molding nozzle locations. When gas assist injection molding is used, gas is injected at the sprues and at other locations; and gas flows with plastic along the ribs. Thus, a side benefit of ribs is that they provide channels in which plastic flows, to fill the mold. Ribs supplement, or can in part eliminate the need for, runners and thickened cross sections, which are needed for obtain a properly filled mold. U.S. Pat. No. 5,401,459 of Nichols et al. describes some of problems and solutions associated with obtaining proper flow distribution in a molded chamber.

When such kinds of chambers are shipped from the factory to distributors and to points of use, they are nested. The number of chambers which can be carried by a vehicle is a function of the cargo volume, rather than weight. Thus, how closely or densely the chambers nest becomes of economic interest with respect to shipping costs. Heretofore, the necessity of having ribs for strength limited the density of nesting. Thus, if localized chamber wall thickness increases were necessary to provide plastic flow channels, they could be included since nesting height was not adversely affected.

Some newer chamber designs are shown in commonly owned U.S. patent application Ser. Nos. 10/402,414 filed May 4, 2001, No. 09/849,768 filed May 28, 2003, both of Kruger et al., and in No. 10/677,938 of Brochu et al., filed Oct. 1, 2003. The improved design enables a corrugated chamber which does not need strengthening ribs and has better nesting than the old chambers. The strength of the improved engineered design chambers arises from the shape of the corrugations and the curve of the arch shape cross section, as described in the referenced applications. Furthermore, some of the newer chambers have thinner walls, of the order of 0.090 inch compared to around 0.150 inch in older chambers. The newer designs provide substantially improved nesting.

The absence of ribs and the thin walls in the new design chambers can create special manufacturing problems with respect to plastic flow and injection molding, which must be overcome to obtain a sound product. To obtain good fill of the mold in such circumstances, a good number of closely spaced sprues can be used, as can substantially increased injection pressure. However, often product design, and mold and machine factors, urge in the opposite direction. In another approach, the chamber design can be altered, so the wall thickness is increased locally to create flow channels for plastic. However, when the latter approach is employed, particularly when the need is to get good feeding along the length of a chamber, there can be an adverse effect on nesting height as detailed further in the description which follows. Thus, there is a need for new approaches inchamber design or manufacturing method, which improve melted plastic flow but do not adversely affect nesting height.

SUMMARY

An object of the invention is improve flow of melted plastic and fill of the mold, during manufacturing arch shape cross section corrugated chambers, without use of ribs, flow channels, or other features which change the nesting height of chambers. Another object is to provide a substantially rib-free chamber design which has a good nesting and good design for filling during injection molding without a large number of sprues.

In accord with the invention, an injection molded plastic corrugated leaching or storm water chamber has one or more peak corrugations which have a segment where the web is flattened and thickened, compared to other portions of the corrugation. Peak web angle is the angle between two opposing side webs which run up to the peak from the nearby valleys. The increased PWA enables the increased thickness of the web without impact on nesting height.

In a preferred practice of the invention, PWA is increased to a degree sufficient to enable a web thickness increase which achieves the desired flow area during molding, without affecting the nesting height of chambers at all. In another embodiment, nesting height is increased by an amount less than that which would result if web thickness was changed or a rib was added, without also increasing PWA.

In accord with the invention, in the flattened web segment of a chamber corrugation, both PWA and web thickness are substantially increased, compared to the parameters of the remainder of the web, in particular those which limit nesting height. Typically, PWA is increased by at least 8 degrees and thickness is increased at least 20 percent, compared to the properties of the corrugation. An exemplary chamber has a flattened web segment with PWA of about 40 degrees, in the 4 inch wide transverse region at the apex of a chamber corrugation, while PWA is about 12 degrees elsewhere along the corrugation. The web thickness in the center of the flattened web segment is about 0.19 inch compared to 0.09 inch elsewhere along the corrugation web.

In one embodiment of chamber, the flattened web segments are present on two or more adjoining peak corrugations, and the segments and a sprue lie within a band region which runs lengthwise along the chamber. Thus, in the process of making a chamber, melted plastic can flow better along the length of the chamber within the band region, from the injection nozzle point (which results in the sprue on the chamber) to other parts of the chamber, and that improves fill of the mold and material integrity to the chamber. In other embodiments of the invention, the flattened web segments are staggered relative to each other, or are located in spaced apart bands which lie along either side of the chamber length center plane.

The foregoing and other objects, features and advantages of the present invention will become more apparent from the following description of preferred embodiments and accompanying drawings.

DESCRIPTION

The aforementioned Kruger et al. patent application Ser. No. 10/402,414 shows a continuous semi-ellipse curve arch shape cross section corrugated storm chamber. The aforementioned application Ser. No. 10/677,938 of Brochu et al. shows a leaching chamber which while typically is smaller, has many shape and design features in common with the storm chambers. The present invention is particularly useful for those kind of chamber designs. The description and drawings of the foregoing patent applications are hereby incorporated by reference.

Figure 1:
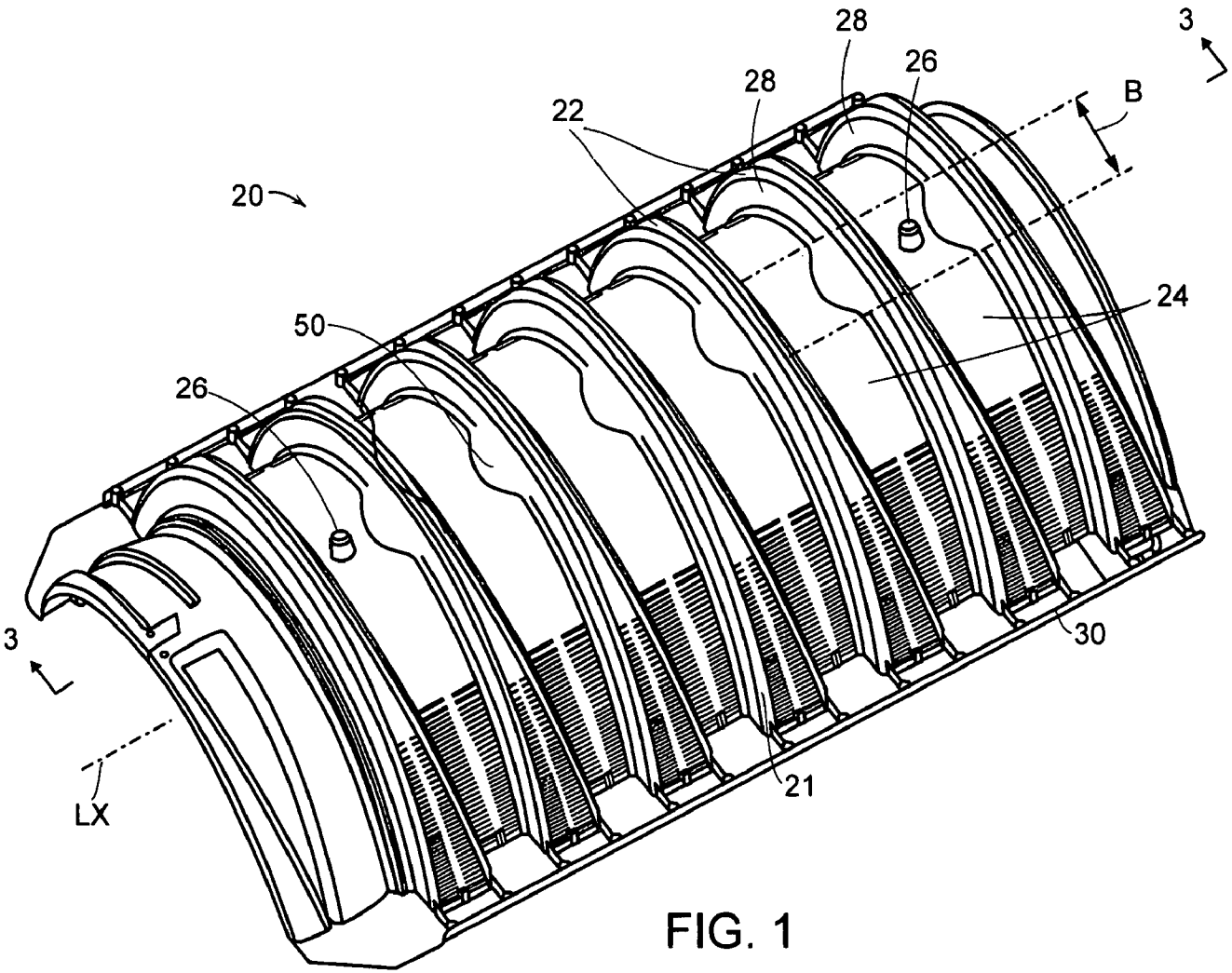
FIG. 1 is a perspective view of a corrugated leaching chamber.
Figure 2:
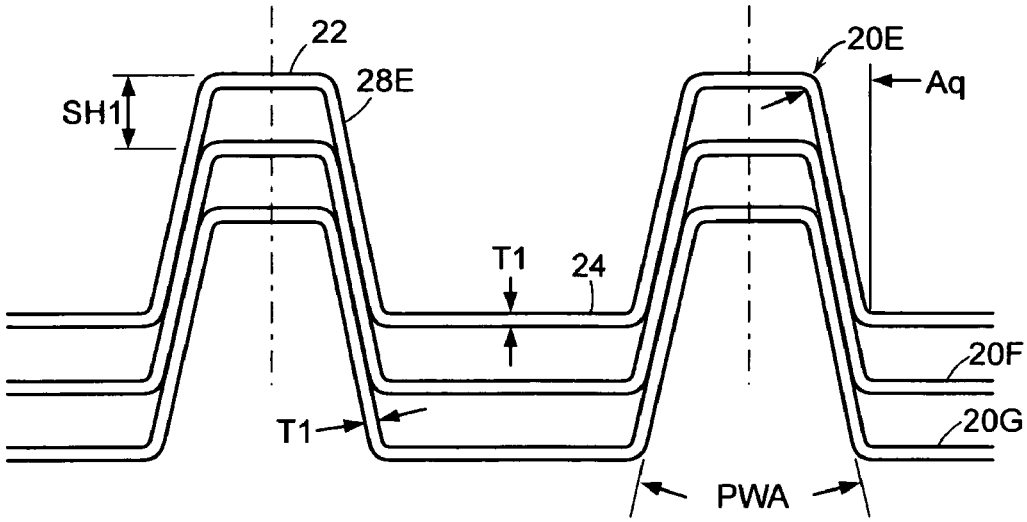
PRIOR ART FIG. 2
FIGS. 2-3 are vertical lengthwise center plane cross sections through the apex portions of three stacked or nested chambers.
Figure 3:
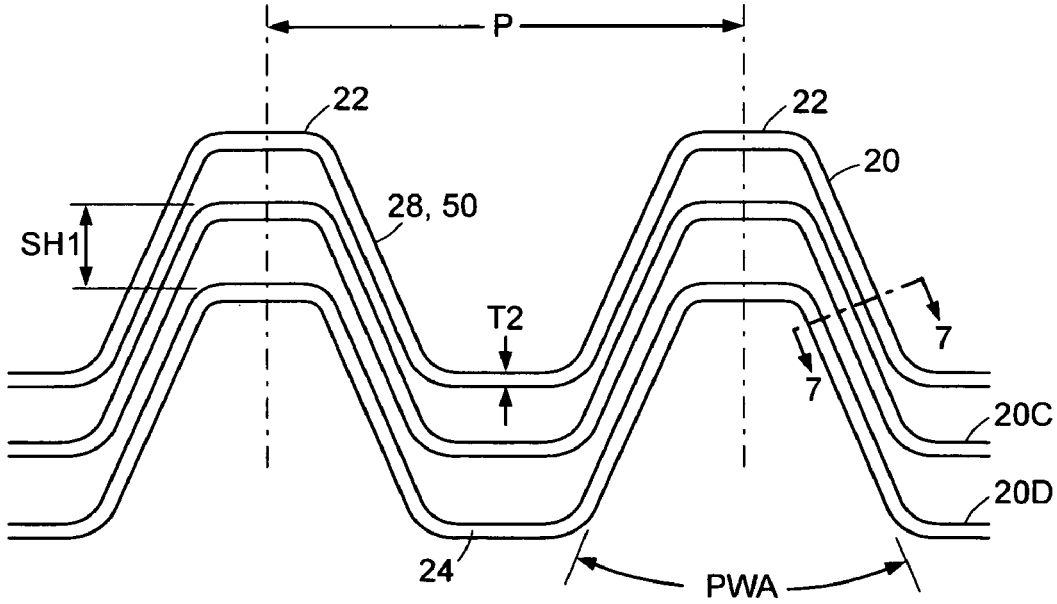

FIG. 1 shows a corrugated arch shape cross section chamber 20 which is useful for leaching wastewater. A chamber used for storm water dispersal is similar in shape, but typically is larger in size and lacks a slotted sidewall 21. The chamber corrugations comprise alternating peak corrugations 22 and valley corrugations 24, spaced part along the chamber lengthwise central axis LX. The corrugations themselves have lengths, which run transverse to the chamber length and axis LX; each corrugation runs up a first side from a first base flange 30, across the top of the chamber, and down the opposing second side of the chamber to the opposing side base flange 30. FIG. 3 shows a portion of the apexes of the three identical chambers 20, 20C, 20D, in vertical center plane cross section. (FIG. 3 shows portions of three nested identical chambers, so that aspect may be discussed below.) FIG. 2 is like FIG. 3, but shows three prior art identical chambers 20E, 20F, 20G. Considering typical chamber 20E in FIG. 2, webs 28E connect the peaks and the valleys. Chamber 20 shows peak corrugations with segments 50 which comprise localized flattened webs. Otherwise the corrugation has web slopes which are steep, in accord with the prior art.

A typical leaching chamber 20 is about 4 feet long. 23-34 inch wide at the base, and 12-13 inch high. It has 0.090 inch typical wall thickness leaching chamber, and is formed by injection molding into the cavity of a mold thermoplastic, such as materials which are predominately of high density polyethylene or polypropylene, preferably using gas-assisted molding technique. For methods of molding see U.S. Pat. Nos. 4,247,515, 4,234,642, 4,136,220, all to Oblasi, and No. 4,101,617 to Friedrich, the disclosures of which are hereby incorporated by reference. See also U.S. Pat. No. 5,716,163, to Nichols and Moore. During molding, plastic flows into the mold through injection nozzle ports, which leave telltale sprues 26, also called gates, on the chamber surface. For simplicity, chamber 20 is shown with two sprues 26, lying along the vertical center plane of the chamber. More sprues may be used; and, they may be differently located.

In the corrugated chambers, nesting is limited by interference (contact) of the sloped webs 28 of stacked chambers, as illustrated by FIG. 2 which shows a fragmentary vertical cross section view of portions at the apexes of three stacked prior art chambers. (In practice, stacking lugs, or molded pieces near the base flange 30 prevent wedging of the peaks.) The vertical distance between one chamber and an overlying or underlying chamber is called the nesting height, SH, also sometimes called the stacking height. It is desirable to have low SH, since that means more chambers can be contained with a given vertical space, as on a transport vehicle.

The prior art chamber 20E shown in FIG. 2 has a constant wall thickness T1. Each web has an angle Aa with respect to the vertical cross section plane of the chamber. In the prior art, a typical angle Aa is about 6 degrees. For purposes of describing and claiming the invention here, the webs 28 which run from a peak are considered here as part of peak corrugation 22; and, thus included angle A between webs on either side of a peak is called the Peak Web Angle or PWA. (Webs could be characterized alternatively as being part of the valley. The better view, in prior descriptions, is that webs connect the peak and valleys and are not "owned" by either.) PWA is about 12 degrees in a preferred embodiment prior art chamber, as well as in corrugations of preferred embodiments here, other than in the flattened web region Low values of PWA are desirable because they provide strength to the corrugations.

Figure 4:
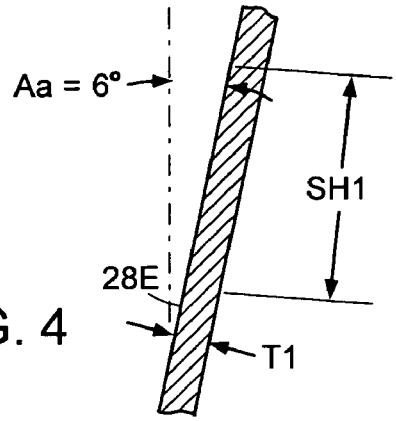
FIGS. 4-6 are vertical centerline cross sections through portion of webs of the chambers of FIGS. 2-3.
Figure 5:
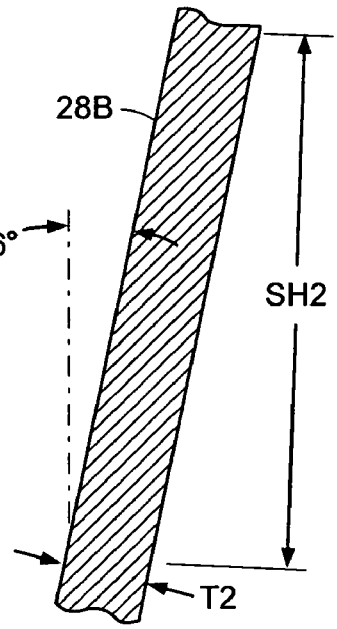
Figure 6:
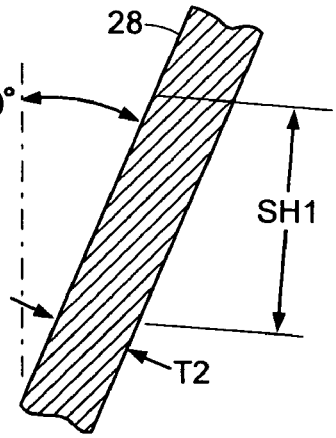

From FIG. 2, and FIG. 4-5 discussed next, it can be appreciated that if thickness T1 is increased, nesting height SH1 also increases. But, suppose it is desirable or necessary to have increased flow lengthwise along the top of a prior art chamber, for instance, from either sprue 26 toward corrugations at the center of the chamber 20. Suppose the thickness T1 of the chamber is increased in a four inch wide band running along the length of the chamber, between the sprues; and, the band is centered on the chamber top. The increase in web thickness will increase the nesting height, as illustrated by FIGS. 4 and 5. FIG. 4 shows a web 28 of the chamber shown in FIG. 2, where angle Aa of about 6 degrees, web thickness is T1 and nesting height is SH1. FIG. 5 shows the web 28C having the desired increased thickness T2. The nesting height is increased to SH2. However, suppose as illustrated by FIG. 6 and as done in the invention, the thickened web section is given a greater incline. For example, suppose angle Aa is flattened so it is about 20 degrees from the transverse vertical plane, as illustrated in FIG. 3 and FIG. 6. It is seen that even though web wall thickness is increased to T2, nesting height remains at SH1.

The region or segment in which web angle is changed and web thickened is called the flattened web region. This name is used because at the apex the web is made more nearly flat with respect to horizontal and the base of the chamber. When corrugation shape for regions other than apex is rotated into the vertical plane, the same flattening will be seen. A corrugation with a flattened web portion, has a portion in which PWA is increased, compared to PWA of the web in adjacent portions of the corrugation. Thickness is likewise compared.

FIG. 3 emphasizes the point. It shows the apex portions of three nested identical chambers 20, 20D, 20E, having PWA of about 40 degrees. Comparing FIG. 3 with FIG. 2, the wall thickness of the chamber is substantially and visibly thicker. The chamber horizontal portions, at the peaks and valleys of the corrugations, are also increased in thickness (as they could have been in absence of the invention, without adverse effect on nesting height). Thus, it is seen that flattening the webs enables chambers of FIG. 3 to have the same SH1 as have the chambers in FIG. 2, even though web thickness is increased. Thus a zone of increased thickness and better plastic or gas assist flow have been created, running along the length of the top of the chamber.

Preferably, PWA is only increased where, and to a degree which, is necessary to allow the part thickness needed to achieve the desired flow, so as to not complicate design or unduly compromise PWA strength. Thus, as suggested by the embodiment of FIG. 1, increased PWA is confined to a relatively small width band B, which analysis and testing shows does not have an unacceptable effect on chamber performance. Outside of band B, the corrugations will have lesser PWA, e.g., they will have the slope and thickness shown in FIG. 2. See the whole chamber shown in FIG. 1.

Usually, a certain minimum nesting height will result from a particular chamber design. Often this will be a consequence of the fit of the corrugations at several locations, typically including the chamber apex. Thus, when the invention is applied to any such location it will not change nesting height. In some chamber embodiments, an increase in nesting height due to use of the invention might be accepted, but the increase will be less than that which would obtain in absence of the invention. In some rare instances of chamber design, it might be possible to reduce nesting height by use of the invention.

The chamber configurations with which the invention is particularly useful don't have ribs. Ribs in prior art chambers take various forms. Typically, they run lengthwise and transversely on the inside and outside of the chamber. For a description of ribs, and how they can create places for plastic flow during molding, including through the webs, see U.S. Pat. No. 5,716,163 to Nichols et al.

Chambers with which the invention is most useful, including chamber 20 typically do have flow channels or runners. Compared to ribs, those features are less pronounced and usually blend smoothly into the chamber surface at their edges. They are not intended for strengthening, i.e., for increasing section modulus. The runners run both lengthwise or transversely, mostly on the interior of the chamber, typically from sprue locations. For instance, a 0.09 inch wall chamber may have runners which are about 0.4 inch wide by 0.15 inch high on the interior surface. In contrast a strengthening rib on such a chamber would have a height of 0.5 inch or more, and aspect ratios described in aforementioned U.S. Pat. No. 5,716,163. The strengthening-rib-free chambers of the preferred embodiments of the invention may have lengthwise discontinuous interior fin structures for baffling, designed to channel water from a dosing pipe at the apex of a chamber. They are discontinuous, and contrary to a design intended for strengthening, so they don't increase nesting height.

The runners and water channeling fins are typically positioned in locations where they don't increase nesting height, i.e., where there would otherwise be a gap between nested chambers. Of course, strengthening ribs may nonetheless be used in such chambers in the same way runners may be placed in the gap regions. The invention may be used with chambers which have ribs, when changing web thickness would increase nesting height, and that is to be avoided.

The following is an example of the invention, applied to the typical leaching chamber 20: Each corrugation has a segment 50 lying within a band B of about 4 inch width. The segment 50 may generally be called the apex region, as, is centered on the top of the chamber. PWA varies within the region 50; and, the maximum, at the vertical center plane location, is about 40 degrees. The web thickness T2 also varies in the region; and, the maximum is about 0.19 inch, also at the center. At either boundary of the band, PWA is about 12 degrees and web thickness T1 is about 0.09 inch. The latter angle and thickness characterize the adjacent and remainder portions of the corrugation. In this example, the maximum web thickness within the flattened web region, i.e., within band B, is thus somewhat more than 100% greater than the thickness of the web outside the band, which thickness is also the typical thickness of the rest of the chamber.

In the invention, the thickness in the flattened web or increased PWA segment, e.g., within the band B of FIG. 1, will be substantially greater, i.e., at least 20 percent, more usually 50 percent or more, than the thickness which typifies the web of corrugation portions outside of and adjacent to band B. While chamber corrugations typically have uniform PWA and thickness, in the generality of the invention, those parameters may vary, compared to the parameters adjacent to the flattened web segment (band B). The desired increase in web thickness typically will drive what flattening or increased PWA is necessary. However, maximum thickness in the segment may be less than increased PWA enables. In the invention, angle PWA in the flattened web segment of the corrugation will be substantially greater, i.e., at least 8 degrees, more often at least 12 degrees greater than PWA in the rest of the same corrugation.

Figure 7:
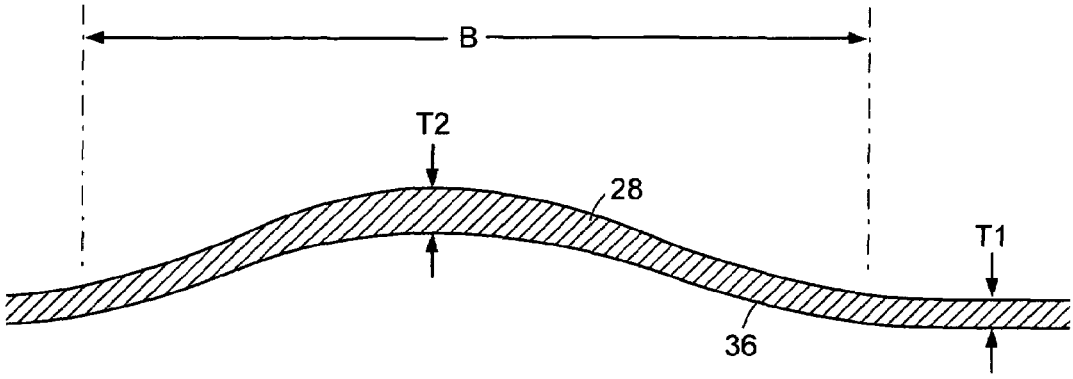
FIG. 7 is a transverse plane cross section through a web having increased peak web angle (PWA) and a smooth thickness transition.
Figure 8:
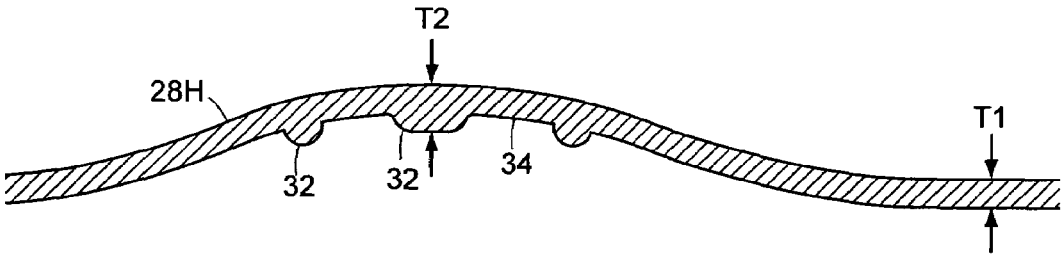
FIG. 8 is like FIG. 7, but shows a web which has spaced apart plastic flow channels.

Preferably, there is a smooth function transition area 36 is at the edges of the band, of both PWA and web thickness T, as illustrated by FIG. 7, a transverse plane cross section through the web. In an alternate embodiment, the web wall thickness may abruptly transition to the typical thickness at the end of the band, as may PWA transition from the increased PWA to the PWA of the remainder of the corrugation. In another embodiment, illustrated by FIG. 8, instead of a thicker web which tapers from a maximum at the center, as in FIG. 7, there may be one or more spaced apart flow channels 32, running in the lengthwise direction along the web. The height of the channels 32 is within the web thickness increase envelope 34, which is permitted by the increased PWA.

Figure 9:
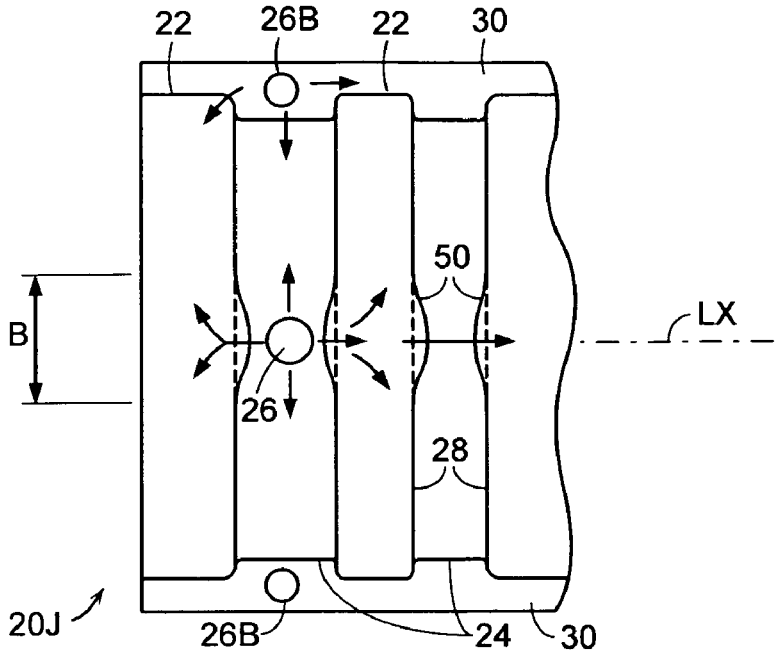
FIG. 9 is a top view of a portion of a chamber like that shown in FIG. 1, to show sprue locations and flow of plastic during molding.
Figure 10:
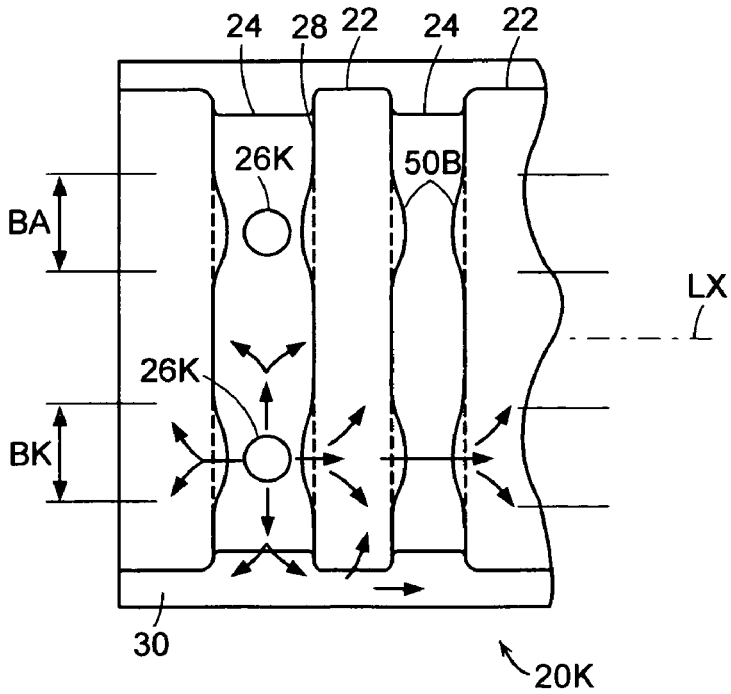
FIG. 10 is like FIG. 9, but shows a chamber with spaced part sprues and associated peak web angle bands on either side of the chamber centerline.

FIG. 9 is a top view of the end of a chamber 20J, to further illustrate how the invention may be applied. In addition to sprues 26 at the top of the chamber, there are sprues 26B at the opposing side base flanges 30. Arrows suggest the flow of plastic during molding. FIG. 10 is like FIG. 9, to illustrate how the invention may be applied to portions of corrugations other than those which are at the apex of the chamber. In FIG. 10, the increased PWA regions 50B are within two bands BA, BK, which run lengthwise along the chamber 20K, on either side of the vertical lengthwise center plane. Thus, there is again increased local web wall thickness and resultant improved feeding from sprues 26K along the length of the chamber, without an increase in nesting height which is unacceptable.

Figure 11:
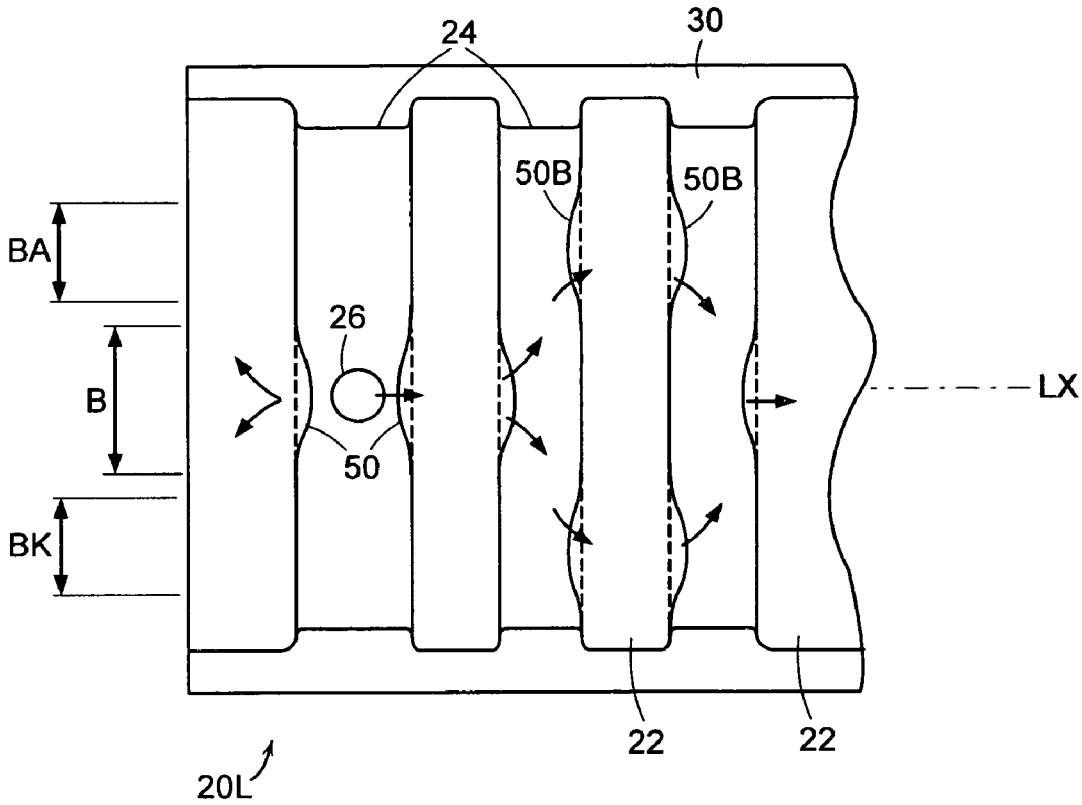
FIG. 11 is like FIG. 9 and FIG. 10 and shows a combination of the spures and web flattenings of FIG. 9 and the sprues and web flattenings of FIG. 10.

The concept of bands has been used for convenience, to illustrate the invention, and not to suggest that the flattened web (increased PWA) portions have to be aligned along the length of the chamber. In the scope of invention, a chamber may have increased PWA sections which are staggered from corrugation to corrugation with respect to their displacement from each other or from the vertical center plane. As an example: A chamber has alternate peak corrugations which have the web-flattened regions 50 of the kind shown in FIG. 9. The inbetween peak corrugations have the web-flattened regions 50B, of the kind shown in FIG. 10. This combination of features is shown in FIG. 11. Thus, as the flow path lines in FIG. 11 indicate, a path for plastic flow during molding is lengthwise through the web of region 50 of a first peak, then down the arch curve within valley 24 to a point, then lengthwise through the web-flattened regions 50B of the next or second peak, then up the arch curve of the next valley to the top of the chamber, and then lengthwise through the web region 50 of the third peak, etc. Staggering of the flattened web regions distributes such weakness (i.e., the decrease in stiffness) as the web flattening introduces.

Usually, the increased PWA segments will be applied to a series of adjoining corrugations, as shown in FIG. 1. However, various alternate embodiments are within contemplation: The increased PWA segment may be applied to a single corrugation, such as one adjacent a sprue; or to two corrugations, one on either side of a sprue; or to only those corrugations which are adjacent to a plurality of spaced apart sprues.

The invention may also be applied to chambers having corrugations which vary in configuration along the length, or along the arch cross section curve, of the chamber. While the invention is described in terms of chambers which have webs with constant angle Aa, if the web is curved in the chamber lengthwise direction, a best fit plane will determine web angle. While the invention has been described in terms of webs which are symmetrically angled relative to a transverse or vertical cross section plane, the invention may be carried out inclining and thickening only one of two webs of a peak corrugation, or by inclining to different degrees the two webs which form a peak corrugation. The invention is especially useful for the chambers which do not have large ribs or flow channels. However, the invention will also be useful with chambers having ribs and flow channels, when an increase in nesting height would result due to thickening of a web.

Although this invention has been shown and described with respect to a preferred embodiment, it will be understood by those skilled in this art that various changes in form and detail thereof may be made without departing from the spirit and scope of the claimed invention.

We claim:

1. In an injection molded thermoplastic arch shape cross section corrugated chamber, useful for receiving and discharging water beneath the surface of the earth; wherein the chamber has an arch top and opposing sides disposed on either side of a lengthwise vertical centerplane, running upwardly to the arch top; wherein the chamber has a multiplicity of alternating peak corrugations separated by valleys, wherein each of said peak corrugations and valleys has a length which runs transverse to the chamber length and up a first side of the chamber, across the arch top of the chamber, and down the opposing side of the chamber; wherein each peak corrugation comprises a pair of opposing-side webs, one of which webs runs to a valley running on along one lengthwise side of the peak corrugation, and the other of which webs runs to a valley running along the opposing lengthwise side of the peak corrugation; wherein the webs of said pair are angled relative to each other and thereby have an associated Peak Web Angle therebetween; the improvement which comprises: at least one peak corrugation having at least one segment of peak corrugation length characterized by (a) a Peak Web Angle which is substantially greater than the Peak Web Angles which characterize portions of said at least one peak corrugation which are adjacent to each of the lengthwise ends of said at least one segment; and, (b) web thicknesses which are substantially greater than the thicknesses of the webs of portions of said at least one peak corrugation which are adjacent to each of the lengthwise ends of said at least one segment.

2. The chamber of claim 1 wherein nesting height of a stack of like chambers is limited by contact of a multiplicity of said webs of a multiplicity of said peak corrugations.

3. The chamber of claim 1 characterized by a multiplicity of said peak corrugations, each peak corrugation having at least one segment of the length thereof which is characterized by:

(a) a Peak Web Angle which is substantially greater than the Peak Web Angles which characterize portions of said at least one peak corrugation which are adjacent to each of the lengthwise ends of said at least one segment; and, (b) web thicknesses which are substantially greater than the thicknesses of the webs of portions of said at least one peak corrugation which are adjacent to each of the lengthwise ends of said at least one segment.

4. The chamber of claim 1 further comprising: at least one sprue positioned within one of the valleys which runs along each opposing lengthwise side of said at least one peak corrugation.

5. The chamber of claim 4 further comprising: a second sprue positioned in one of the valleys which runs alongside said at least one peak corrugation; wherein, the first sprue and second sprue are located on opposing sides of said vertical center plane of the chamber.

6. The chamber of claim 3 wherein all of said multiplicity of segments are at the top of the chamber.

7. The chamber of claim 3 wherein some of said multiplicity of segments are on a first side of the lengthwise vertical centerplane of the chamber and some of said multiplicity of segments are on the second side of said lengthwise vertical centerplane.

8. The chamber of claim 1 wherein said Peak Web Angle associated with said at least one segment is at least about 8 degrees greater than Peak Web Angle associated with said adjacent portions of said at least one peak corrugation.

9. The chamber of claim 8 wherein said Peak Web Angle of said at least one segment is about 40 degrees and wherein the Peak Web Angle of said adjacent portions of said at least one peak corrugation is about 12 degrees.

10. The chamber of claim 1 wherein the web thickness in said at least one segment is at least 20 percent greater than the thickness of the web in the said adjacent portions of said at least one peak corrugation.

11. The chamber of claim 1 wherein the thickness of at least one of the webs of said pair of webs of said at least one segment is greater in thickness near the center of the segment than it is at either end of the segment.

12. The chamber of claim 1 wherein at least one of said webs of said at least one segment comprises one or more plastic flow channels running in the lengthwise direction of the chamber.

13. The chamber of claim 1 wherein the opposing sides and arch top lie along a continuous curve path which defines the upper bound of said arch shape cross section.

14. In an injection molded thermoplastic arch shape cross section corrugated chamber, useful for receiving and discharging water beneath the surface of the earth; wherein the chamber has an arch top and opposing sides disposed on either side of a lengthwise vertical centerplane, running upwardly to the arch top; wherein the chamber has a multiplicity of alternating peak corrugations separated by valleys, wherein each of said peak corrugations and valleys has a length which runs transverse to the chamber length and up a first side of the chamber, across the arch top of the chamber, and down the opposing side of the chamber; wherein each peak corrugation comprises a pair of opposing-side webs, one of which webs runs to a valley running along one lengthwise side of the peak corrugation, and the other of which webs runs to a valley running along the opposing lengthwise side of the peak corrugation; wherein the webs of said pair are angled relative to each other and thereby have an associated Peak Web Angle therebetween; the improvement which comprises: forming at least one segment of the length of at least one of said webs so that (a) the Peak Web Angle which characterizes the segment is substantially greater than the Peak Web Angles which characterize portions of said at least one peak corrugation which are adjacent to each of the lengthwise ends of said at least one segment; and, (b) the thickness of at least one of the webs of said at least one segment is substantially greater than the thicknesses of the webs of portions of said at least one peak corrugation which are adjacent to each of the lengthwise ends of said at least one segment.

15. The chamber of claim 14 characterized by forming a multiplicity of said at least one segments on a multiplicity of different peak corrugations, so all the segments are aligned within a zone which runs lengthwise along the chamber length and parallel to said lengthwise vertical centerplane.

16. In the method of forming a thermoplastic injection molded arch shape cross section corrugated chamber, having an arch top, and opposing sides disposed on either side of a lengthwise centerplane, running upwardly to the arch top; wherein the chamber has a multiplicity of alternating peak corrugations separated by valleys, wherein said peak corrugations and valleys have lengths which run transverse to the chamber length and up a first side of the chamber, across the arch top, and down the opposing side of the chamber; wherein each peak corrugation comprises a pair of opposing-side webs, each of which runs to a valley which runs alongside of the peak corrugation; wherein the webs of said pair are angled relative to each other and thereby have an associated Peak Web Angle therebetween; the improvement which comprises: forming at least one segment of the length of at least one web of at least one peak corrugation so that (a) the Peak Web Angle of the segment is substantially greater than the Peak Web Angles of portions of said at least one peak corrugation which are adjacent to said at least one segment; and (b) the thicknesses of at least one of the webs of said at least one segment is substantially greater than the thicknesses of the webs of portions of said at least one peak corrugation which are adjacent to said at least one segment, to thereby improve the flow of melted plastic within the mold which forms the part during injection molding.

17. The method of claim 16 which further comprises: providing a multiplicity of peak corrugations with one or more segments similar to said at least one segments; and, positioning at least one of said segments in vicinity of a sprue of the molded chamber.

18. The method of claim 17 wherein said segments are disposed on alternating fashion on both sides of said vertical lengthwise centerplane.

* * * * *